United States Patent [19]

Sagarino

[11] 4,033,110

[45] July 5, 1977

[54] SOLID-STATE ELECTRONIC WATCH ASSEMBLY

[75] Inventor: Robert F. Sagarino, Wheatley Heights, N.Y.

[73] Assignee: Bulova Watch Company, Inc., New York, N.Y.

[22] Filed: Dec. 22, 1975

[21] Appl. No.: 643,135

[52] U.S. Cl. ..... 58/88 R; 58/23 BA; 58/50 R

[51] Int. Cl.[2] ..... G04B 37/00

[58] Field of Search ..... 58/23 R, 23 BA, 50 R, 58/88 R

[56] References Cited

UNITED STATES PATENTS

| | | | |
|---|---|---|---|
| 3,672,155 | 4/1972 | Bergey et al. | 58/50 R |
| 3,914,932 | 10/1975 | Teraishi et al. | 58/50 R |
| 3,942,316 | 3/1976 | Van Haaften | 58/88 R |
| 3,945,193 | 3/1976 | Yasuda et al. | 58/23 BA |
| 3,945,196 | 3/1976 | Wood et al. | 58/23 R |
| 3,968,640 | 7/1976 | Clemmer et al. | 58/50 R |
| 3,974,637 | 8/1976 | Bergey et al. | 58/50 R |

*Primary Examiner*—James R. Scott

*Assistant Examiner*—Vit W. Miska

[57] ABSTRACT

A solid-state electronic timepiece movement receivable within a watch case having an end window therein. The movement includes a plastic block provided at its forward end with a ledge on which is seated a module. Mounted on the obverse face of the module and viewable through the window of the watch case are electro-optical stations of a time display. The operating elements of the stations are connected through the body of the module to integrated circuit chips mounted on the back face of the module. These chips provide the circuits of an electronic timekeeping system operating in conjunction with discrete elements housed in the block and constituted by a quartz-crystal unit, a frequency-adjusting capacitor and a pair of power cells as well as time demand and setting switches. The discrete elements are connected to the system by means of a printed circuit board overlying the forward section of the block and provided with a pair of flexible contact fingers extending over the rear section of the block to engage the poles of the power cells which are accommodated in respective hatches formed in the rear section of the block.

6 Claims, 8 Drawing Figures

Integrated Circuit Module
Internal Connections
Back Face
Obverse Face
Frequency Standard
Frequency Converter
Display Actuator
Flexible Connector (FC)
Printed Circuit Board (PC)
Block (HB)
Mo
PT
L1
L2
L3
L4
L5
WC
16
17
10
11
12
13
14
T1
T2
T3
T4
T5
T6
T7
B1
B2
B3
B4
B5
B6
B7
C1
C2
C3
C4
C5
C6
C7
S1
S2
R1
R2
TC
Q

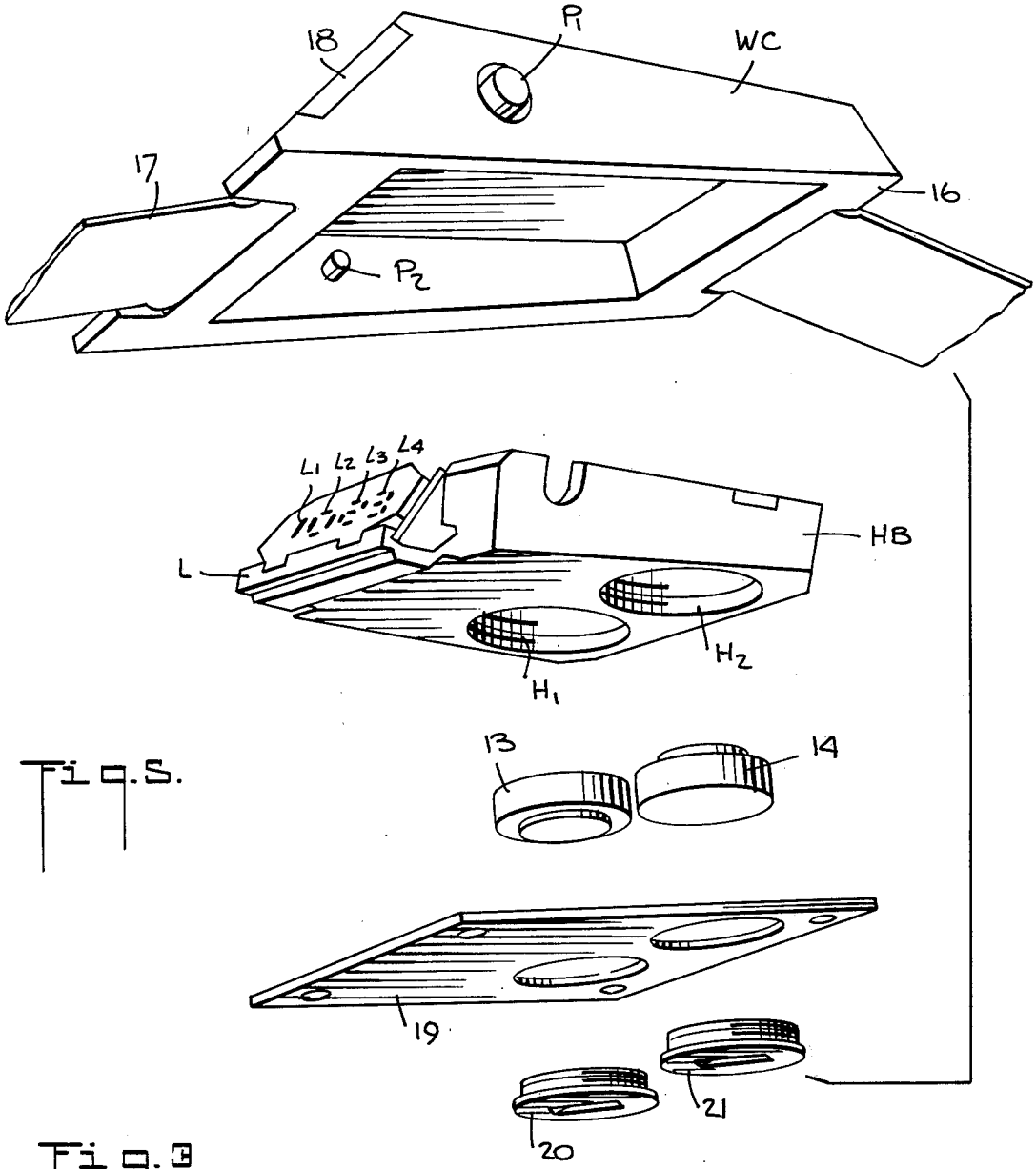
Fig. 5.
Fig. 3
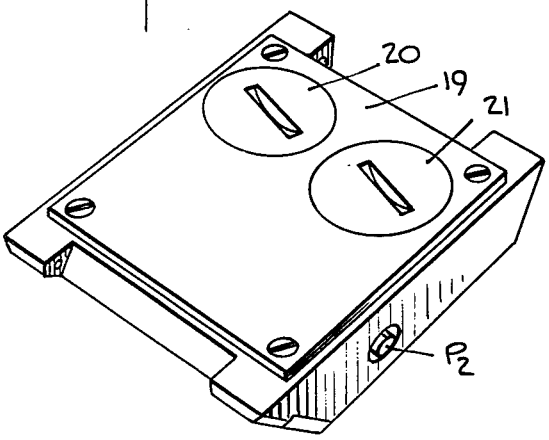
Fig. 4.
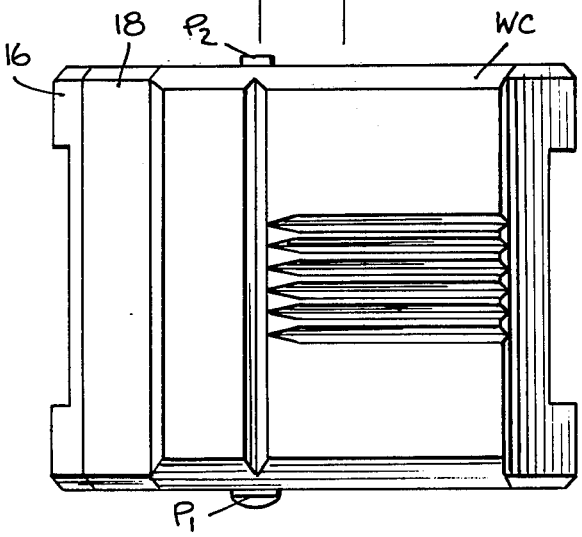

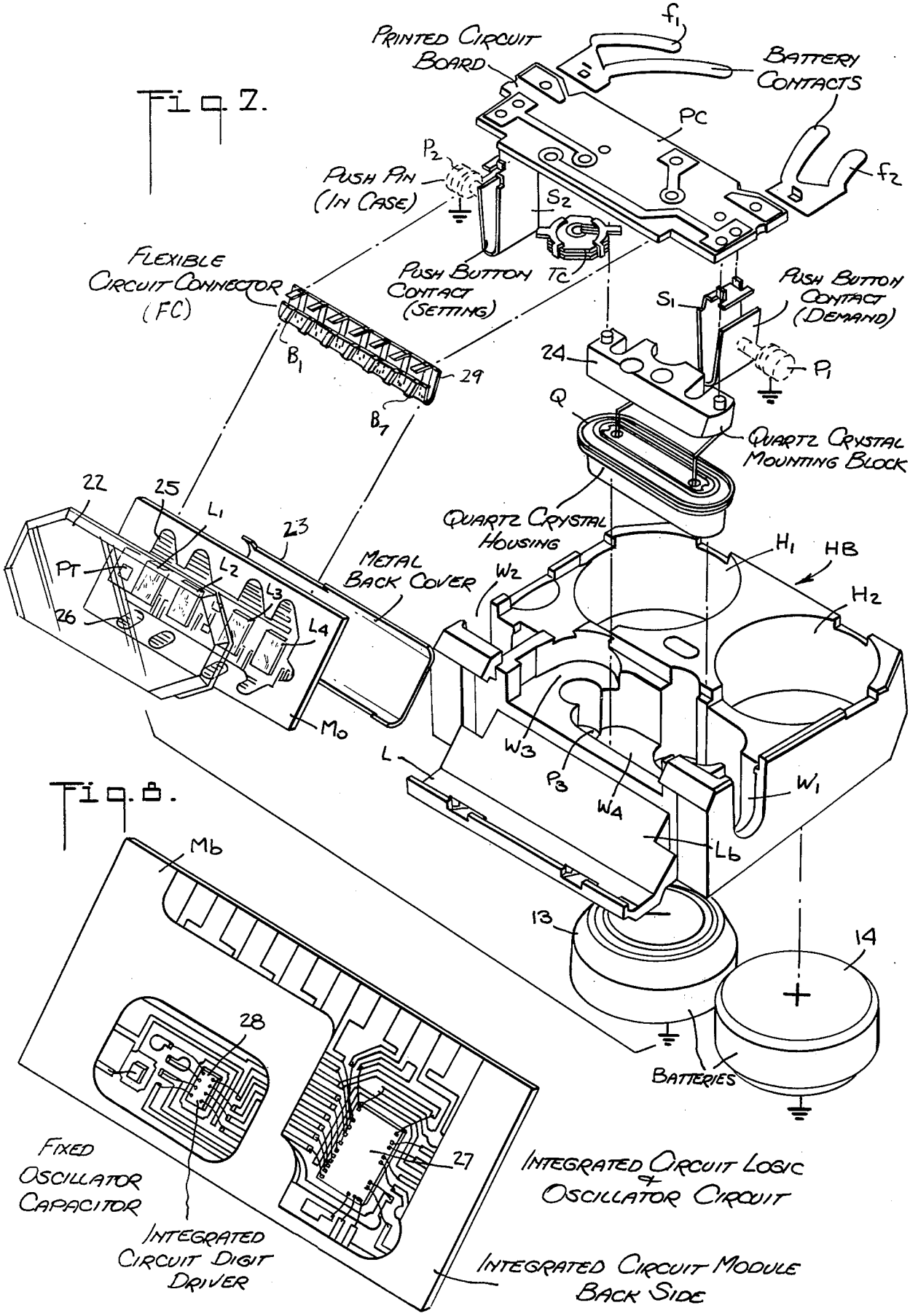
Fig. 7.
Printed Circuit Board
Battery Contacts
PC
$f_1$
$f_2$
$P_2$
Push Pin (In Case)
$S_2$
Push Button Contact (Setting)
Tc
Flexible Circuit Connector (FC)
$B_1$
$B_7$
29
$S_1$
Push Button Contact (Demand)
$P_1$
24
Q
Quartz Crystal Mounting Block
Quartz Crystal Housing
22
25
$L_1$
23
PT
$L_2$
$L_3$
$L_4$
26
Metal Back Cover
$M_0$
$W_2$
$H_1$
HB
$H_2$
L
$W_3$
$P_3$
$W_4$
$W_1$
Lb
13
14
Batteries
Fig. 8.
Mb
28
27
Fixed Oscillator Capacitor
Integrated Circuit Digit Driver
Integrated Circuit Logic + Oscillator Circuit
Integrated Circuit Module Back Side

SOLID-STATE ELECTRONIC WATCH ASSEMBLY

BACKGROUND OF INVENTION

This invention relates generally to solid-state electronic watches, and more particularly to a solid-state watch movement receivable within a watch case having an end window, the movement including a module whose obverse face is viewable through the window and has mounted thereon the electro-optical stations of a time display.

The term "solid-state watch," as used herein, is limited to timepieces provided with an electro-optic time display and having no moving parts. In electronic watches which have a moving-hand read-out, the oscillations at a balance wheel or the vibrations of a tuning fork resonator are electrically sustained. These oscillations or vibrations are converted into rotary motion for driving a gear train which turns the hands of the watch; hence such electronic timepieces are not properly designated solid-state watches.

Since the works of a traditional mechanical watch or of a tuning-fork electronic watch received within a watch case are usually referred to as the "movement," this term will be retained herein for a solid-state watch, despite the absence of any moving parts, thereby distinguishing between the case and the works contained therein.

In the typical solid-state watch, such as the watches disclosed in U.S. Pat. Nos. 3,756,103 and 3,759,031, low-frequency electrical pulses derived from a high-frequency crystal-controlled time base serve to actuate a multi-digit electro-optical display formed either by light-emitting diodes (LED) or by liquid-crystal display elements (LCD), no moving parts being entailed. In such solid-state watches, the output of the quartz-crystal oscillator is fed to a frequency converter constituted by a chain of divider stages. Low-frequency timing pulses yielded by the converter are applied to a display actuator in the form of a miniature time-computer that counts the input train, encodes it in binary form and then decodes and processes the resultant data to provide appropriate activating signals for the display stations.

The power requirements for an LED time display are high, and should the display be continuous, the life of the miniature power cell installed in the watch would be brief. It is for this reason that commercially available watches having an LED display are normally quiescent, the display being turned on only when the user depresses a demand switch.

In one such LED watch, the display is programmed so the with a momentary depression of the demand switch, the minutes and hours are indicated--whereas continued depression of the switch causes the minutes and hours to fade and the seconds to appear and to count as long as the demand buttom is held in. In this type of arrangement, which is disclosed in U.S. Pat. Nos. 3,560,990; 3,576,099 and 3,664,118, precise computation of time is continuous and independent of whether or not it is displayed, so that the moment one touches the demand switch, timing signals are applied to the display.

Of particular interest in the context of the present invention is the U.S. Pat. No. 3,803,827 of Roberts, the disclosure of which is incorporated herein by reference. In the solid-state LED watch illustrated in this patent, the movement is formed by a one-piece frame which houses the entire wrist-watch assembly, including a pair of power cells and cystal oscillator and a trimmer capacitor. The LED display stations are mounted in a package placed on the frame and are viewable through the window on top of the watch case. Ready access may be had to the power cells and the trimmer capacitor by removal of the back of the watch case.

While the modular solid-state watch construction disclosed in U.S. Pat. No. 3,803,827 facilitates the assembly, adjustment and repair of the movement and makes it easy to replace the batteries, a large number of leads and other discrete conductor are required to make connections to terminals of the time display LED package and connections to the terminals of the integrate circuit forming the electronic timekeeping system. Thus in putting together a solid-state watch of the type disclosed in this patent, it is not simply a matter of fitting modules together within a case, for an elaborate hook-up procedure is involved which adds substantially to the cost of producing such watches.

SUMMARY OF INVENTION

In view of the foregoing, it is the main object of this invention to provide a solid-state watch, the configuration of whose movement is such as to greatly simplify the final assembly thereof, the simplified nature of the movement facilitating repair and maintenance operations.

More particularly, it is an object of this invention to provide an electronic watch whose case is provided with an end window and whose movement has a module seated at the forward end thereof, whereby electro-optical display stations mounted on the obverse face of the module are viewable through the window.

A significant feature of a module in accordance with the invention is that the integrated circuits of the electronic timekeeping system associated with the display stations are mounted on the back face of the same module and are connected to the elements of the display stations by printed circuit connections extending through the body of the module whereby the entire system is incorporated in a single module, except for the discrete elements thereof constituted by the power cells, the crystal unit, the trimmer capacitor and the operating switches.

It is also an object of this invention to provide a movement for a solid-state watch in which the single module which incorporates the display stations and the integrated circuits associated therewith is electrically coupled to the discrete elements by a printed circuit board which overlies an insulating block housing these elements.

Yet another object of the invention is to provide a solid-state watch which makes possible a highly compact form without crowding of the components thereof, the watch being efficient, accurate and reliable.

Briefly stated, in a solid-state electronic timepiece in accordance with the invention, the movement is receivable within a watch case having an end window therein, the movement including a plastic housing block provided at its forward end with a ledge. Seated on the ledge is a module on whose obverse face are mounted the stations of an LED time display which are viewable through the case window.

The operating elements of the LED display stations are connected through the body of the module to integrated circuit chips mounted on the back face of the module. The chips form the circuits of an electronic time-keeping system constituted by a high-frequency time base whose output is applied to a frequencey converter producing low frequency timing pulses which are applied to the actuator for the LED display. The system operates in conjunction with discrete elements housed in the block and constituted by a quartz-crystal resonator, a frequency-adjusting capacitor, a pair of power cells and a time-demand and setting switch.

These discrete elements are connected to the module circuits by means of a printed circuit board which overlies the forward section of the block and is provided with a pair of flexible contact fingers extending over the rear section of the block to engage the poles of the power cells which are accomodated in respective hatches formed in the rear section.

The crystal unit, the trimmer capacitor and the fixed contacts of the demand and setting switches are supported on the underside of the printed circuit board and are recived within respective chambers formed in the forward section of the block. The switches are completed by push-pins projecting through the watch case and grounded thereby, the pins engaging the fixed contacts housed within the block.

The printed circuit board is physically joined to the module and is electrically coupled thereto by means of a flexible connector having a linear array of bridges which interconnect a row of terminals on the underside of the board with a corresponding row of terminals on the back face of the module, whereby to assemble the movement, it is merely necessary to seat the module on the ledge of the block and to install the printed circuit board on top of the forward section thereof.

OUTLINE OF DRAWINGS

For a better understanding of the invention as well as other objects and further features thereof, reference is made to the following detailed description to be read in conjunction with the accompanying drawings, wherein:

FIG. 3 is a perspective view of the assembly as seen looking toward the back of the case;

FIG. 4 is a top plan view of the assembly;

FIG. 5 is an exploded view of the movement and case forming the assembly;

FIG. 7 is an exploded view of the components of movement; and

FIG. 8 is a separate view of the back face of the module supporting the integrated circuit chips.

DESCRIPTION OF INVENTION

The Electronic Timekeeping System:

Before considering the physical structure of the movement and of the watch case which together form the assembly of a solid-state electronic watch in accordance with the invention, the electronic timekeeping system which is embodied in the movement shall first be disclosed schematically so that it will later be evident how the several components of the watch are physically and electrically coordinated.

Figures 1, 2:
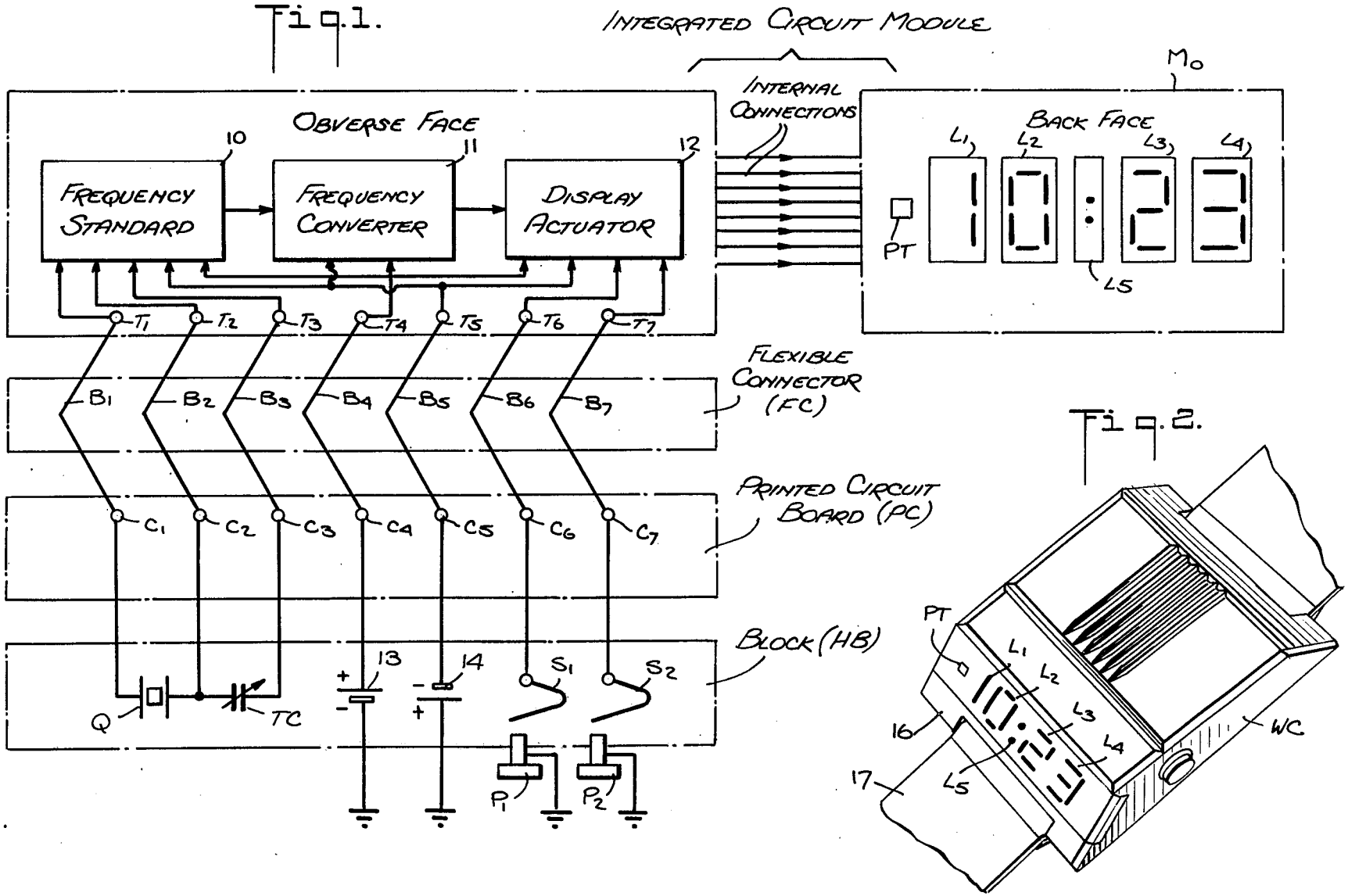
FIG. 1 is a block diagram of the movement of a solid-state electronic watch assembly in accordance with the invention.
FIG. 2 is a perpective view of the solid-state electronic watch assembly, as seen looking toward the time display window.

As shown in FIG. 1, the movement includes a single module in the form of a rectangular insulting plate on whose back face $M_b$ are mounted integrated circuit chips whose circuits are constituted by a time base or high-frequencey standard 10, a frequency converter 11 and a display actuator 12. The integrated circuits on the back face of module $M_b$ are provided with a row of terminals $T_1$ to $I_7$ which are connected by means of the bridging straps of a flexible connector FC to a corresponding row of terminals $C_1$ to $C_7$ on a printed circuit board PC, and by way of this board to discrete elements housed within a plastic insulating housing block HB.

These elements are a quartz-crystal resonator unit Q, a frequency-adjusting trimmer capacitor TC, first and second miniature power cells 13 and 14, a time demand switch formed by a contact $S_1$ operating in conjunction with a push-pin $P_1$ and a setting switch formed by a contact $S_2$ operating in conjunction with a push-pin $P_2$.

Mounted on the obverse face $M_0$ of the module is a digital time display constituted by four LED stations $L_1$, $L_2$, $L_3$ and $L_4$. Between the second and third stations there is interposed an LED colon $L_4$ to separate hours from minutes, such as the 10:30 illustrated. Also mounted on obverse face $M_0$ is a phototransistor PT which is responsive to the level of ambient light and functions to adjust the intensity of light emitted by the LED display stations accordingly. Thus when the ambient light level is high, as during daytime display, the diode light intensity is raised so that the display is readable in bright light, and when ambient light decreases as in a dark room, the diode intensity is diminished, since much less light emission is they necessary to render the display readable. Phototransistor PT and the elements of the LED display stations mounted on the obverse face of the module are connected by printed circuit leads 15 passing through the body of the module to the display actuator 12 on the back face of the module.

Time base 10 is constituted by a high-frequency oscillator circuit operating in conjunction with crystal unit Q, the connection thereto being made by bridging straps $B_1$ and $B_2$ which connect terminals $T_1$ and $T_2$ to terminals $C_1$ and $C_2$. Fine tuning of the frequency of this oscillator is effected by means of trimmer capacitor TC which is connected to time base 10 by means of terminals $C_2$ and $C_3$, which are connected to terminals $T_2$ and $T_3$ through bridging straps $B_2$ and $B_3$ of the flexible connector FC.

The output of time 10 is supplied to frequency converter 11 which takes the form of a multi-stage divider that divides down the frequency from the time base to produce an output signal having a low timing rate, such as 1 Hz. This signal is fed to a display actuator 12 consitituted by a suitable logic circuit for operating the four stations $L_1$ to $L_4$ of the LED display. In the conventional LED digital station, in order to selectively present numerals 0 to 9, seven LED segments are required in a geometric arrangement which creates the numeral 8 when all seven segments are simultaneously activated. The omission of the horizontal center segment creates the numeral 0, and the omission of one or more of other segments defines the remaining numerals. To create numeral 1, only a long vertical line formed by two co-linear vertical segments is necessary, as shown at station $L_1$.

Time base 10, frequency converter 11 and display actuator 12 are energized by replaceable battery cells 13 and 14. The negative pole of cell 13 is connected to these stages of the system by way of terminals $T_4$ and $C_4$ bridged by strap $B_4$, the positive pole being grounded through the watch case. The positive pole of battery cell 14 is connected to stages 10, 11 and 12 of the system through terminals $C_5$ and $T_5$ bridged by strap $B_5$, the negative pole being grounded through the watch case. Switch $S_1$ 14 $P_1$ is connected to display actuator 12 by terminals $C_6$ and $T_6$ bridged by strap $B_6$, while switch $S_2 - P_2$ is similarly connected to the actuator through terminals $C_7$ and $T_7$ bridged by strap $B_7$.

In normal position, time is continuously being kept by the system but is not presented by the LED display, this being the normal condition which prevails in order to conserve battery power. However, even though the time is not displayed, the system continues to keep accurate time and is capable of displaying the time or calendar date at any instant when demand switch $S_1 - P_1$ is actuated.

Setting switch $S_2 - P_2$ serves to place the movement in the setting mode, making it possible to adjust any one of the various readings. The arrangement of the setting switch may be such that when this switch is momentarily pressed in and released, then the hours reading is presented which may then be advanced one step at a time by pressing and releasing the demand buttom. By again pressing and releasing the setting button, the minutes reading is presented, which may then be advanced one step at a time by pressing and releasing the demand button. The switch is returned to the time display mode by pressing and releasing the setting button a predetermined number of times.

In practice, the watch may include a month and date read-out which is rendered effective by proper manipulation of the demand button, in which event the setting switch arrangement is such as to present month and date readings in the setting mode, so that these too can be advanced by operation of the demand button. The specific details of the electronic timekeeping system and the manner in which the switches function to select time functions and to set the time readings forms no part of the present invention.

It is to be understood that the present invention is not limited to solid-state electronic watches having particular multi-function time displays and externally operated switches to selectively activate the display and to set the various readings. Regardless of the number of stations in the display and the number of associated switches, the watch will in all instances include an electro-optic display, an electronic timekeeping system in integrated circuit form for generating the necessary time signals and for actuating the display stations, a crystal unit, a trimmer capacitor, and power cells, all of which must be housed within the watch case.

The purpose of the present invention is to provide a highly compact watch assembly wherein a single module which incorportes the time display stations and the integrated circuits associated therewith and all the discrete components of the movement are properly positioned on or within a housing block and are interconnected with each other, whereby the movement is easily assembled and installed within the watch case so that the watch functions efficiently and reliably.

THE WATCH ASSEMBLY

Referring now to FIGS. 2 to 7, there are shown the physical structures of the movement and the case of the solid-state watch assembly in accordance with the invention.

The watch case WC is of a trapezoidal configuration and is provided at its opposite ends with a pair of lugs 16 to which a watch band or bracelet 17 is attachable in the usual manner. The viewing end of the case is sloped to enhance the readability of the time display on the wrist of the weaver, the end having a rectangular window 18 therein behind which are disposed the display stations $L_1$ to $L_4$ and the phototransistor PT mounted on the obverse face $M_0$ of the module.

The back 19 of the case is provided with a pair of disc-shaped threaded hatch covers 20 and 21 which are removable to provide access to hatches $H_1$ and $H_2$ formed in the rear section of the housing block HB for receiving power cells 13 and 14.

It will be seen that one side wall of case WC is provided with a hole in which is inserted push-pin $P_1$ of the demand switch. The fixed contact $S_1$ engaged by the pin is housed in a well $W_1$ adjacent the corresponding side wall of block HB in the forward section thereof. Similarly, pin $P_2$ of the setting switch is inserted in a hole in the opposite side wall of case WC to engage fixed contact $S_2$ housed in a well $W_2$ adjacent the corresponding side wall of block HB.

Projecting from the forward section of housing block HB is a ledge L whose inclined back wall $L_b$ is adapted to support the module of the movement at an angle which matches the inclination of window 18 in the case. The obverse face $M_0$ of the module is protectively covered by a transport plastic front shield 22, whereas the back face $M_b$ thereof is covered by a metal back shield 23.

Printed circuit board PC, as best seen in FIG. 7, is provided with flexible metal fingers $f_1$ and $f_2$ which reach out over the rear section of housing block HB and are adapted to engage one pole of the battery cells 13 and 14 received in hatches $H_1$ and $H_2$, the other poles being engaged by hatch covers 20 and 21 which, because they are part of the case back, are grounded.

Supported on the underside of the printed circuit board PC at the short ends thereof are the contacts $S_1$ and $S_2$ of the operating switches, which contacts extend into wells $W_1$ and $W_2$ in the block HB. Also supported at the underside of the board is the trimmer capacitor TC which is received in a well $W_3$ in the block HB having a port $P_3$ to provide access from the back of the watch for a tool to adjust the trimmer. The quartz-crystal unit Q is supported on a plastic mounting block 24 secured to the underside of the board PC, the crystal unit Q being received in a well $W_4$ in the block.

Thus when printed circuit board PC is seated on the housing block, the various discrete elements of the movement, namely crystal unit Q, trimmer capacitor TC, switch contacts $S_1$ and $S_2$ received in block and protectively housed thereby, the spring fingers then overlying the battery cell hatches $H_1$ and $H_2$.

Figure 6:
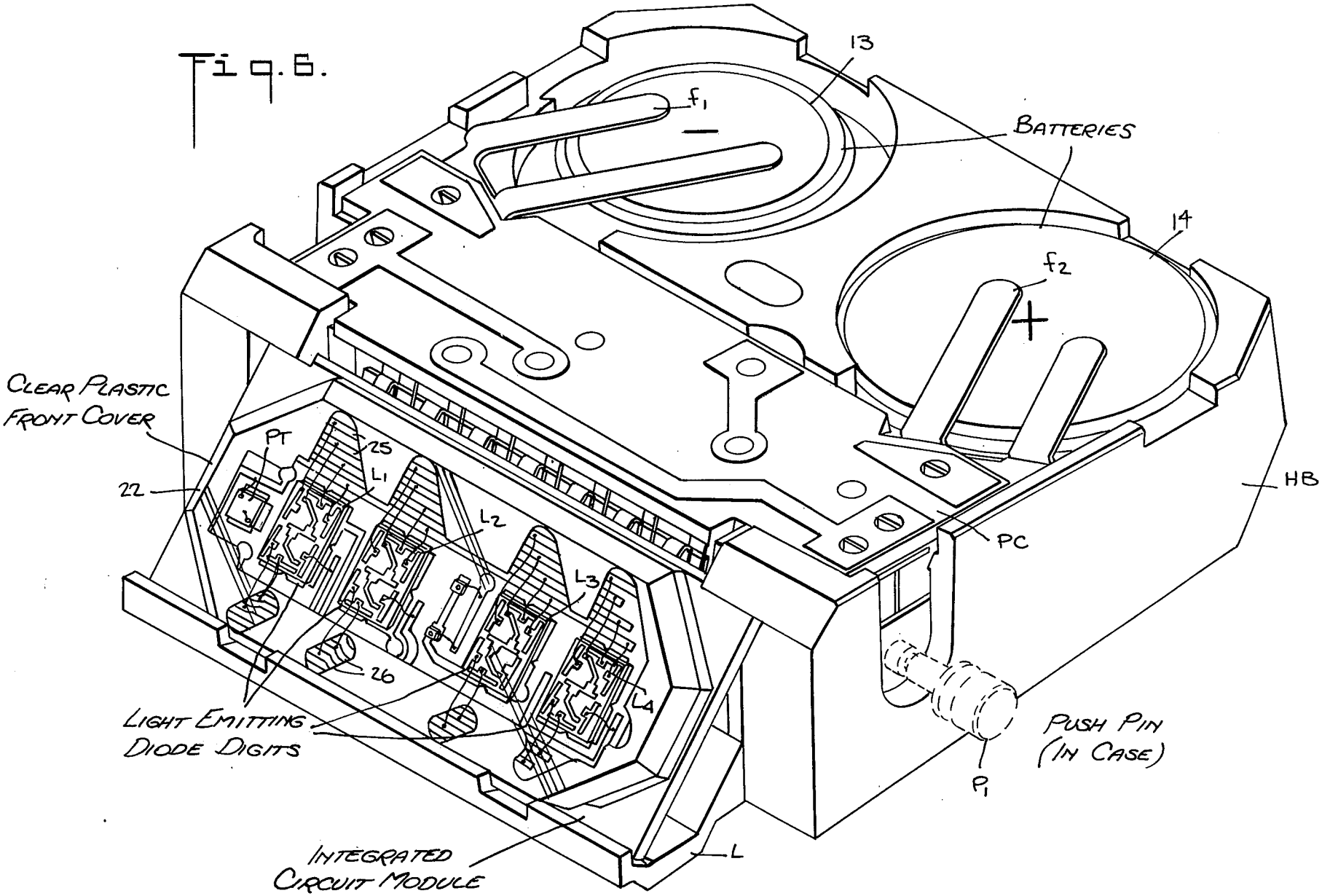
FIG. 6 is a perspective view of the movement.

As best seen in FIGS. 6 and 7, the various electro-optic elements which define the LED stations $L_1$ to $L_5$ and the phototransistor PT mounted on the obverse face $M_0$ of the module are wired by leads to printed circuit conductive bars 25 and 26 above and below these stations. The conductive bars are connected by conductive lines extending through the interior of the module to bars printed on the back face $M_b$ of the module which in turn are wired by leads to the appropriate contacts of the integrated circuit chips mounted on the face.

As best seen in FIG. 8, mounted on the back face $M_b$ of the module are the stages 10, 11 and 12 of the electronic time-keeping system which are formed by an integrated circuit chip 27 incorporating the oscillator circuit of the time base 10 and the logic associated therewith to provide time pulses for actuating the LED stations, and by a second integrated circuit chip 28 which forms the driver for the LED digits.

As best seen in FIG. 7, flexible connector FC is formed by a rectangular strip 29 of flexible plastic material to which are secured a row of U-shaped conductive bridging straps $B_1$ to $B_7$, whose arms are soldered to interconnect the terminals of the module to the terminals of the printed circuit board PC in the manner illustrated in FIG. 1. This flexible connector also functions to physically hinge the module to the printed circuit board so that in assembling the movement, one has merely to place the printed circuit board on the forward section of the housing block HB whereby the discrete elements supported below the board are received in the wells in the blocks, and to rest the module against ledge L.

While there has been shown and described a preferred embodiment of a solid-state electronic watch assembly in accordance with the invention, it will be appreciated that many changes and modifications may be made therein without, however, departing from the essential spirit thereof.

I claim:

1. In a solid state electronic watch assembly provided with a watch case having a window at one end thereof; a movement insertable in said case, said movement comprising:

A. a module constituted by a dielectric plate on whose obverse face is mounted the electro-optical stations of a time display, each station being formed by a pattern of display elements which are selectively activatable to define different digits, the back face of said plate having integratedcircuit chips mounted thereon to provide the circuits of an electronic timekeeping system which is operable in conjunction with discrete elements and is energized by at least one replaceable power cell, the integrated circuits on the back face being connected by leads passing internally through said plate to said display elements on the obverse face to afford a time display, said back face having a row of module termnals thereon which are connected to said integrated circuits;

B. a generally rectangular housing block having wells formed in its forward section to receive said discrete elements and at least one hatch formed in its rear section to receive said cell, said block having a ledge on its forward end on which said module is seatable with its obverse face viewable through said window to expose said time display;

C. a rigid printed circuit board overlying the forward section of the block, the discrete elements which are receivable in said wells being supported from the underside of the board, said board having at least one connecting finger extending therefrom which overlies the rear section to engage said cell receivable in said hatch, said discrete elements and said finger being connected by said printed circuit to a corresponding row of board terminals; and D. a flexible connector joining said module to said board and having a array of contacts bridging the module and board terminal rows, the module and the board joined thereto by the connector constituting a unitary sub-assembly which when placed over the housing block with the module seated on the ledge, with the discrete elements received in the wells, and with the finger engaging the cell received in the hatch thereby completes the movement.

2. An assembly as set forth in claim 1, wherein said station elements are formed by light-emitting diodes.

3. An assembly as set forth in claim 1, wherein said timekeeping system including a crystal-controlled oscillator, and one of said discrete elements is a quartz crystal unit for said oscillator.

4. An assembly as set forth in claim 1, wherein another of said discrete elements is a trimmer capacitor for said oscillator.

5. An assembly as set forth in claim 1, wherein said watch further includes a time demand switch and a setting switch whose fixed contacts are supported on the underside of the board and are accommodated in wells formed adjacent the opposite edge of the block, said fixed contacts cooperating with push pins projecting through the watch case to engage the fixed contacts.

6. An assembly as set forth in claim 1, wherein said case is provided with a back having hatch covers to provide access to the hatches containing said power cells.

* * * * *

UNITED STATES PATENT OFFICE

CERTIFICATE OF CORRECTION

Page one

Patent No. 4,033,110 Dated July 5, 1977

Inventor(s) Robert F. Sagarino

It is certified that error appears in the above-identified patent and that said Letters Patent are hereby corrected as shown below:

Column 1, line 53 "the" 1st instance, should have read -- that --

Column 1, line 57 "buttom" should have read -- button --

Column 2, line 2 "cystal" should have read -- crystal --

Column 2, line 13 "conductor" should have read -- conductors --

Column 2, line 16 "grate" should have read -- grated --

Column 3, line 15 "accomodated" should have read -- accommodated --

Column 3, line 20 "recived" should have read -- received --

Column 3, line 68 "insulting" should have read -- insulating --

Column 3, line 3 "frequencey" should have read -- frequency --

Column 4, line 3 "frequencey" should have read -- frequency --

Column 4, line 6 "$I_7$" should have read -- $T_7$ --

Column 4, line 21 "10:30" should have read -- 10:23 --

Column 4, line 30 "they" should have read -- then --

Column 4, line 47 after "time" -- base -- should have been inserted

Column 4, line 53 "sitituted" should have read -- stituted --

UNITED STATES PATENT OFFICE

CERTIFICATE OF CORRECTION

Patent No. 4,033,110 Dated July 5, 1977

Inventor(s) Robert F. Sagarino

It is certified that error appears in the above-identified patent and that said Letters Patent are hereby corrected as shown below:

Column 5, line 6 "14" should have read -- - --

Column 5, line 55 "incorportes" should have read -- incorporates --

Column 5, line 24 "buttom" should have read -- button --

Column 6, line 6 "weaver" should have read -- wearer --

Column 7, line 38 "integratedcircuit" should have read -- integrated-circuit --

Column 7, line 47 "termnals" should have read -- terminals --

Column 8, line 18 "a" should have read -- an --

Signed and Sealed this

*Eighth* Day of *November 1977*

[SEAL]

*Attest:*

RUTH C. MASON
*Attesting Officer*

LUTRELLE F. PARKER
*Acting Commissioner of Patents and Trademarks*